US010663907B2

(12) United States Patent
Ichikawa

(10) Patent No.: US 10,663,907 B2
(45) Date of Patent: May 26, 2020

(54) POWDER COLLECTION DEVICE AND IMAGE FORMING APPARATUS

(71) Applicant: FUJI XEROX CO.,LTD., Tokyo (JP)

(72) Inventor: Yuzo Ichikawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 237 days.

(21) Appl. No.: 15/942,444

(22) Filed: Mar. 31, 2018

(65) Prior Publication Data

US 2019/0033773 A1 Jan. 31, 2019

(30) Foreign Application Priority Data

Jul. 25, 2017 (JP) ..... 2017-143226

(51) Int. Cl.
*G03G 21/10* (2006.01)
*G03G 21/12* (2006.01)

(52) U.S. Cl.
CPC ..... *G03G 21/105* (2013.01); *G03G 21/12* (2013.01)

(58) Field of Classification Search
CPC ..... G03G 21/105; G03G 21/12
See application file for complete search history.

(56) References Cited

U.S. PATENT DOCUMENTS

2005/0220515 A1* 10/2005 Wakana ..... G03G 21/12 399/358
2010/0080600 A1* 4/2010 Okamoto ..... G03G 21/12 399/71
2010/0166461 A1* 7/2010 Sakurai ..... G03G 21/12 399/123
2012/0237230 A1* 9/2012 Karasawa ..... G03G 21/12 399/35
2014/0010579 A1* 1/2014 Yoshino ..... G03G 21/105 399/358
2014/0270821 A1* 9/2014 Takahashi ..... G03G 21/105 399/35

FOREIGN PATENT DOCUMENTS

JP 2001-109343 4/2001
JP 2006-091039 4/2006

* cited by examiner

*Primary Examiner* — Susan S Lee
(74) *Attorney, Agent, or Firm* — JCIPRNET

(57) ABSTRACT

A powder collection device includes a powder collection container, a first transport member, at least one second transport member, and an entrance suppressing member. The powder collection container is removably mounted in an apparatus. The first transport member is disposed in the powder collection container, extends in a first transport direction, and is to transport the powder to a downstream side in the first transport direction. The at least one second transport member extends in a second transport direction. The at least one second transport member transports the powder in the second transport direction so as to pass the powder to the first transport member. The entrance suppressing member suppresses entrance of the powder into a gap between the first transport member and an end portion of the at least one second transport member.

17 Claims, 7 Drawing Sheets

POWDER COLLECTION DEVICE AND IMAGE FORMING APPARATUS

CROSS-REFERENCE TO RELATED APPLICATIONS

This application is based on and claims priority under 35 USC 119 from Japanese Patent Application No. 2017-143226 filed Jul. 25, 2017.

BACKGROUND

Technical Field

The present invention relates to a powder collection device and an image forming apparatus.

SUMMARY

According to an aspect of the present invention, a powder collection device includes a powder collection container, a first transport member, at least one second transport member, and an entrance suppressing member. The powder collection container is removably mounted in an apparatus in which powder is collected. The first transport member is disposed in the powder collection container, extends in a first transport direction, and is to transport the powder received on an upstream side in the first transport direction to a downstream side in the first transport direction when the first transport member is rotated. The at least one second transport member extends in a second transport direction. The at least one second transport member has an end portion which is inserted into the powder collection container and which is positioned, in a mounting orientation in which the powder collection container is mounted in the apparatus, above part of the first transport member on the upstream side. The at least one second transport member transports, when the at least one second transport member is rotated, the powder in the second transport direction and passes the powder to part of the first transport member positioned below the end portion in the mounting orientation. The entrance suppressing member suppresses entrance of the powder into a gap between the first transport member and the end portion of the at least one second transport member when the powder collection container is reoriented such that the upstream side and the downstream side are respectively disposed at a lower position than a position of the upstream side in the mounting orientation and an upper position than a position of the downstream side in the mounting orientation.

BRIEF DESCRIPTION OF THE DRAWINGS

Exemplary embodiments of the present invention will be described in detail based on the following figures, wherein.

DETAILED DESCRIPTION

Embodiments according to the present invention are described below.

Figure 1:
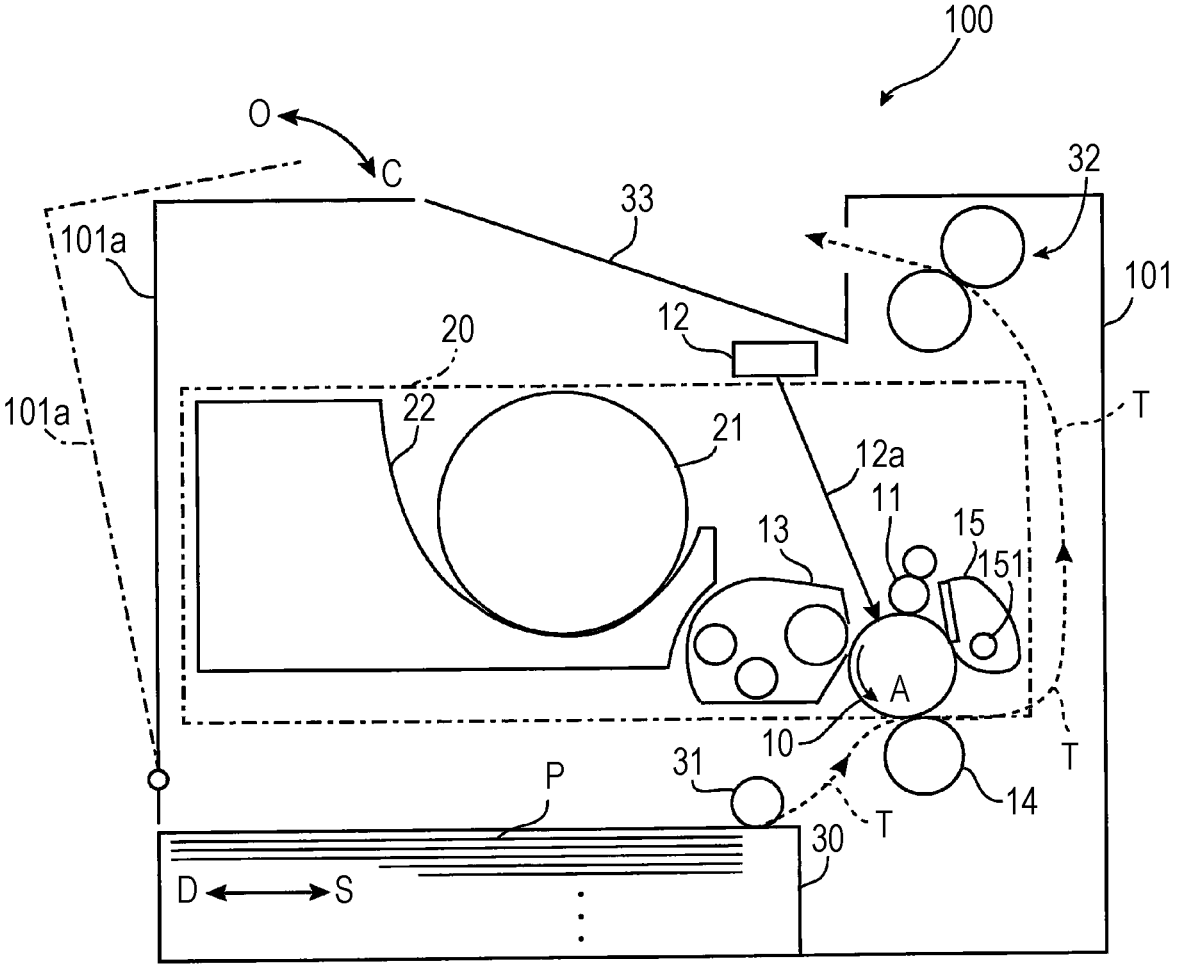
FIG. 1 is a schematic structural view of a printer according to an embodiment of the present invention.

FIG. 1 is a schematic structural view of a printer according to an embodiment of the present invention. A waste toner collection device of an embodiment of a powder collection device according to the present invention is disposed in the printer illustrated in FIG. 1.

This printer 100 includes an image holding body 10 rotated in an arrow A direction. A charger 11, a light exposure device 12, a developing device 13, a transfer device 14, and a cleaner 15 are disposed around the image holding body 10.

The charger 11 charges the image holding body 10.

The light exposure device 12 causes exposure light 12*a* to scan on the image holding body 10 so as to form an electrostatic latent image on the image holding body 10.

Developer that includes toner and carrier is contained in the developing device 13. The developing device 13 develops with the toner included in the developer the electrostatic latent image on the image holding body 10 so as to form a toner image on the image holding body 10.

Furthermore, the printer 100 includes a toner supply container 21 in which the toner is contained. The toner in the developing device 13 is consumed for, for example, developing the electrostatic latent image. Accordingly, the toner in the toner supply container 21 is supplied to the developing device 13 in accordance with the consumption of the toner in the developing device 13.

The transfer device 14 transfers the toner image formed on the image holding body 10 onto a sheet of paper P transported along a sheet transport path T.

The toner or the like remaining on the image holding body 10 after the transfer is scraped off by the cleaner 15 from the image holding body 10. The toner scraped off by the cleaner 15 is transported by a transport auger 151 in a direction perpendicular to the page of FIG. 1 and contained in a waste toner collection container 22 through a detour path.

A sheet tray 30 is provided in a lower portion of the printer 100. The sheet tray 30 is slidable in an arrow D direction and an arrow S direction. The sheet tray 30 is drawn to the outside of the printer 100 in the arrow D direction, and sheets of paper P are contained in this sheet tray 30. The sheet tray 30 is then slid in the arrow S direction so as to be contained in the printer 100.

One of the sheets P contained in the sheet tray 30 is picked up by a pickup roller 31 and transported through the sheet transport path T. The toner image on the image holding body 10 is transferred by an operation of the transfer device 14 onto the sheet P having been transported. The sheet P onto which the toner image has been transferred is further transported along the sheet transport path T and subjected to heat and pressure applied by a fixing device 32. Thus, the toner image on the sheet P is fixed onto the sheet P. Then, the sheet P on which an image that is formed by the fixed toner image has been formed is output to a sheet output tray 33 provided in an upper surface of the printer 100.

Here, out of the elements of the printer 100, the image holding body 10, the charger 11, the developing device 13, the cleaner 15, the toner supply container 21, and the waste toner collection container 22 are integrated with one another into a unit, that is, a process unit 20. This process unit 20 is removably mounted as a single unit in a housing 101 of the printer 100. Part of the housing 101 of the printer 100 is a door 101*a* able to be opened/closed in an arrow O direction and an arrow C direction about a hinge. The process unit 20 is mounted/removed by opening the door 101*a*.

Figure 2:
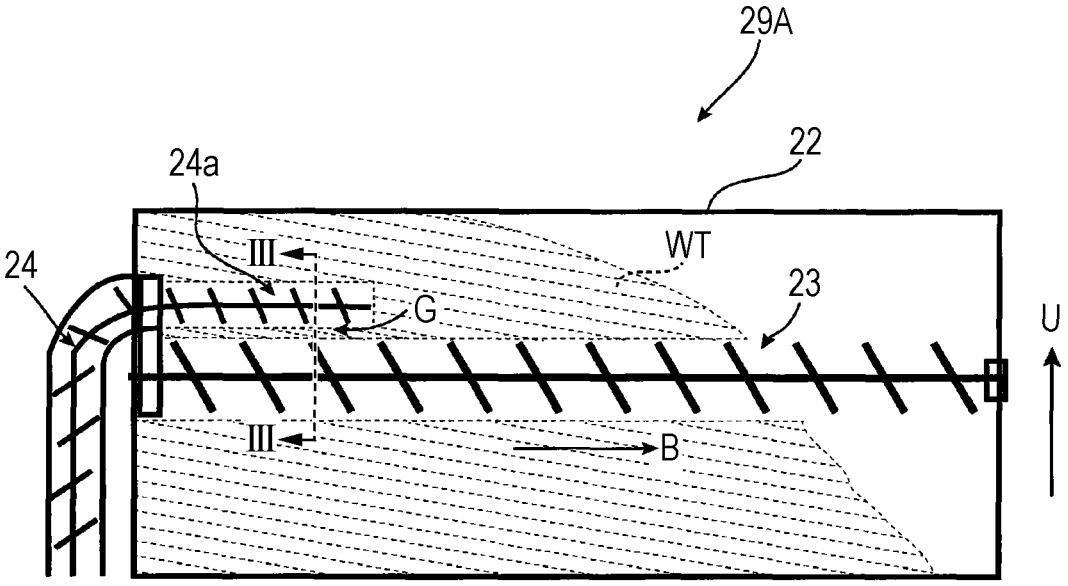
FIG. 2 is a schematic sectional view of a waste toner collection device.

FIG. 2 is a schematic sectional view of a waste toner collection device as a comparative example.

Figure 3:
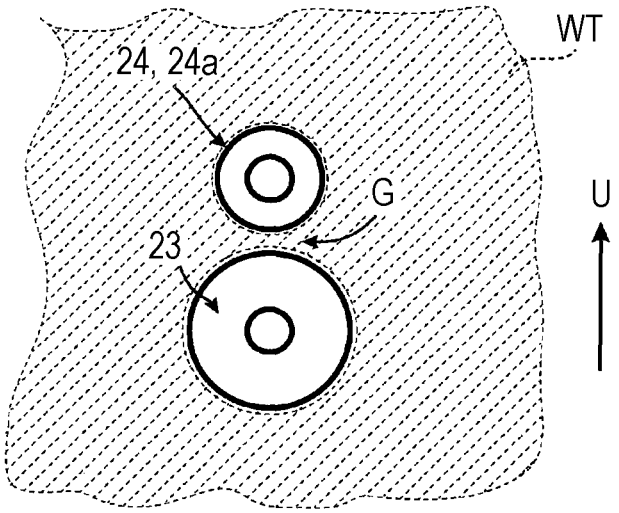
FIG. 3 is a schematic sectional view of part of the inside of a waste toner collection container illustrating a section indicated by arrows illustrated in FIG. 2.

FIG. 3 is a schematic sectional view of part of the waste toner collection device illustrated in FIG. 2 illustrating a section indicated by arrows III-III illustrated in FIG. 2.

A waste toner collection device 29A illustrated in FIGS. 2 and 3 is the comparative example to be compared with the embodiments of the present invention.

An arrow U illustrated in FIG. 2 indicates an upper direction based on an orientation of the waste toner collection container 22 mounted in the printer 100. Unless otherwise specified, directions referred to in the following description indicate directions based on an orientation of the waste toner collection container 22 mounted in the printer 100.

A first auger 23 is oriented so as to extend substantially parallel to a direction indicated by an arrow B in which waste toner is transported. The first auger 23 is rotated by receiving rotating drive from a drive source (not illustrated) so as to transport waste toner WT received at an upstream portion (left side in FIG. 2) toward a downstream portion (right side in FIG. 2) in the transport direction indicated by the arrow B.

Furthermore, a second auger 24 is an extended portion of the auger 151 in the cleaner 15 illustrated in FIG. 1 extended toward the waste toner collection container 22. An end portion 24*a* of the second auger 24 is inserted into the waste toner collection container 22 at a position above the first auger 23 on the upstream side (left side in FIG. 2). The second auger 24 is rotated by a drive source (not illustrated). The waste toner WT is transported to the waste toner collection container 22 due to the rotation of the second auger 24 and passed to the first auger 23 positioned below the end portion 24*a*.

Here, as illustrated in FIG. 1, the waste toner collection container 22 is assembled in the process unit 20, and the entirety of the process unit 20 is removably mounted in the housing 101 of a printer 100.

It is assumed that this waste toner collection container 22 in which a certain amount of the waste toner WT has been collected is removed from the printer 100 when the process unit 20 including the waste toner collection container 22 is removed from the printer 100. When the removed process unit 20 is oriented so that the left side of the waste toner collection container 22 in FIG. 2 is the lower side and the right side of the waste toner collection container 22 in FIG. 2 is on the upper side, the waste toner WT on the left side in FIG. 2 is pushed by gravity. When the waste toner WT on the left side in FIG. 2 is pushed, a gap G between the first auger 23 and the second auger 24 is filled with the waste toner WT in this waste toner collection container 22. Thus, the waste toner WT does not necessarily easily pass through the gap G. After that, the process unit 20 including this waste toner collection container 22 is mounted so as to be normally oriented in the housing 101 of the printer 100.

In the case where a printing operation is performed after the removal and mounting of the process unit 20 involving such reorientation, although the waste toner WT is transported by the second auger 24, the transported waste toner WT is blocked by the waste toner WT that fills the gap G. Thus, the waste toner WT having been transported is accumulated at the end portion 24*a* instead of dropping from the end portion 24*a* of the second auger 24 to the first auger 23. This may clog a transport path of the second auger 24 and result in losing an ability to collect the waste toner WT.

Hereafter, the embodiments of the present invention will be described while being aware of the phenomenon occurring with the comparative example illustrated in FIGS. 2 and 3. In the following description of the embodiments, elements corresponding to the elements of the waste toner collection device 29A of the comparative example illustrated in FIGS. 2 and 3 are denoted by the same reference signs as those in FIGS. 2 and 3.

Figure 4:
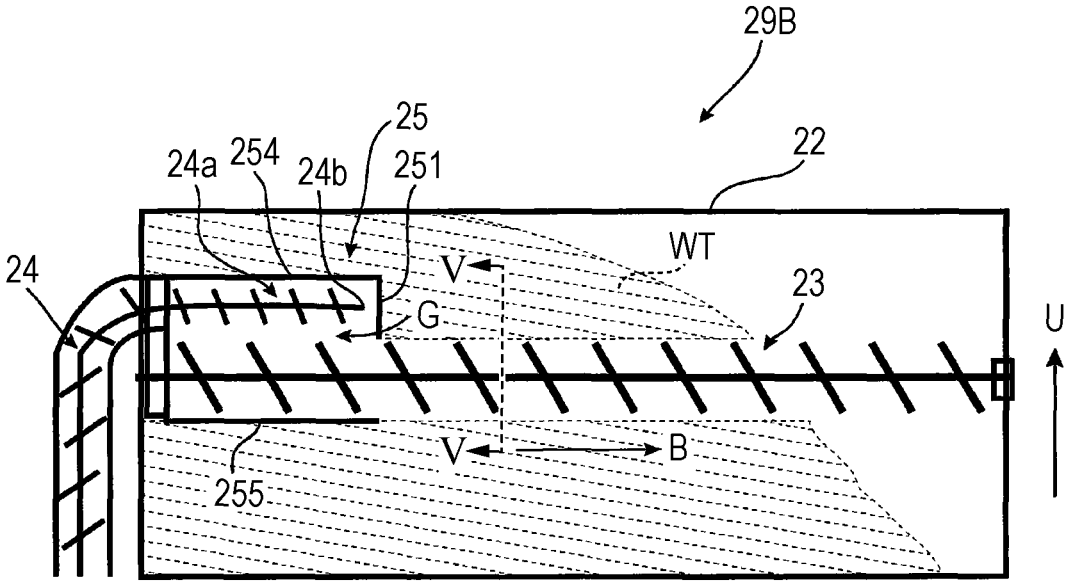
FIG. 4 is a schematic sectional view of a waste toner collection device according to a first exemplary embodiment of the present invention.

FIG. 4 is a schematic sectional view of a waste toner collection device according to a first exemplary embodiment of the present invention.

Figure 5:
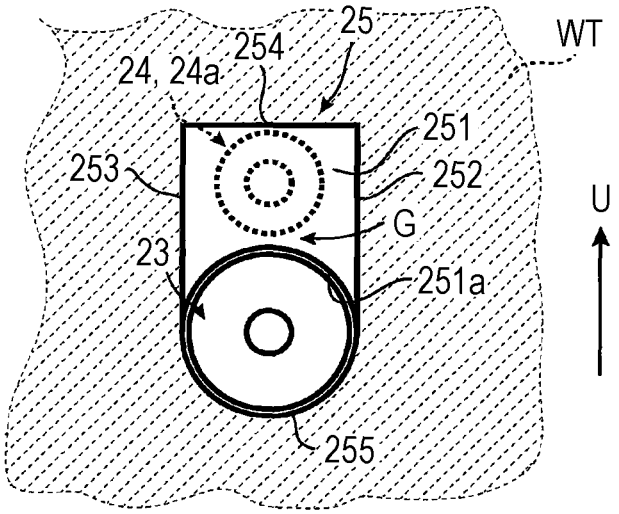
FIG. 5 is a schematic sectional view of part of the inside of a waste toner collection container illustrating a section indicated by arrows V-V illustrated in FIG. 4.

Furthermore, FIG. 5 is a schematic sectional view of part of the inside of the waste toner collection container illustrating a section indicated by arrows V-V illustrated in FIG. 4.

A waste toner collection device 29B illustrated in FIG. 4 is provided with the waste toner collection container 22, the first auger 23, and the second auger 24 having the same structures as those of the waste toner collection device 29A illustrated in FIG. 2 as the comparative example. Furthermore, the waste toner collection device 29B is provided with an entrance suppressing member 25. The entrance suppressing member 25 suppresses entrance of the waste toner WT into the gap G (also see FIGS. 2 and 3). Furthermore, in the case of the waste toner collection device 29B illustrated in FIG. 4, the end portion 24*a* of the second auger 24 extends parallel to the direction of the first auger 23.

Here, the waste toner collection container 22, the first auger 23, the second auger 24, and the entrance suppressing member 25 respectively correspond to examples of a powder collection container, a first transport member, a second transport member, and an entrance suppressing member described in the present invention.

The entrance suppressing member 25 has a box shape that includes a front plate 251, a first side plate 252, a second side plate 253, an upper plate 254, and a lower plate 255. An upstream portion of the first auger 23 and the end portion 24*a* of the second auger 24 are disposed in the entrance suppressing member 25.

The front plate 251 faces an end 24*b* of the end portion 24*a* of the second auger 24. The front plate 251 extends to a position where the front plate 251 intersects the first auger 23 and has an opening 251*a* through which the first auger 23 is inserted. The shape of the opening 251*a* follows an outer circumference of a locus of rotation of the first auger 23. That is, the first auger 23 includes a rotational shaft 231 and a helical blade 232 provided around the rotational shaft 231. The opening 251*a* has an edge having a shape that follows an outer circumference of the helical blade 232. Since this opening 251*a* has the edge having a shape following the outer circumference of the locus of rotation of the first auger 23, when the waste toner collection container 22 is in a standing orientation in which the left side thereof in FIG. 4 is on the lower side, entrance of the waste toner WT through the opening 251*a* may be more effectively suppressed than in the case where the opening 251*a* has a shape not following the outer circumference of the locus of rotation of the first auger 23, that is, a partially increasing gap is formed between the edge of the opening 251*a* and the outer circumference of the locus of rotation of the first auger 23.

Furthermore, the first side plate 252 of the entrance suppressing member 25 faces one side portion (right side portion in FIG. 5) of the end portion 24*a* of the second auger 24 and a one side portion (right side portion in FIG. 5) of the first auger 23. Likewise, the second side plate 253 faces the other side portion (left side portion in FIG. 5) of the end portion 24*a* of the second auger 24 and the other side portion (left side portion in FIG. 5) of the first auger 23. Here, the lengths of the first side plate 252 and the second side plate 253 are, in a direction in which the first auger 23 extends (arrow B direction), equal to or larger than two turns (about three turns in the example illustrated in FIG. 4) of the helical blade 232. When the lengths of the first side plate 252 and the second side plate 253 are equal to or larger than two turns of the helical blade 232, entrance of the waste toner WT through the opening 251*a* may be more effectively suppressed than in the case where the lengths of the first side plate 252 and the second side plate 253 are smaller than two turns of the helical blade 232.

Furthermore, the entrance suppressing member 25 according to the present exemplary embodiment includes the upper plate 254 and the lower plate 255. According to the present exemplary embodiment, the upper plate 254 of the entrance suppressing member 25 is a flat plate, and the lower plate 255 of the entrance suppressing member 25 is an arc-shaped plate having a shape following the outer circumference of the helical blade 232 of the first auger 23.

The entrance suppressing member 25 according to the present exemplary embodiment has the above-described structure and may strongly suppress entrance of the waste toner WT. However, since the entrance suppressing member 25 has a box shape, time and effort may be taken to combine the entrance suppressing member 25 with the first auger 23 and the second auger 24 in the waste toner collection container 22.

Figure 6:
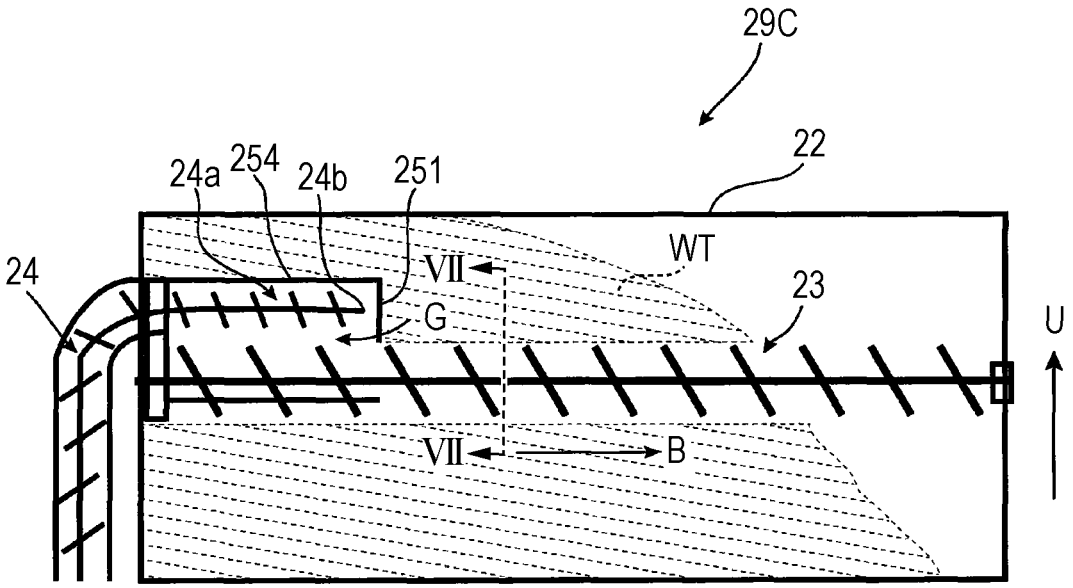
FIG. 6 is a schematic sectional view of a waste toner collection device according to a second exemplary embodiment of the present invention.

FIG. 6 is a schematic sectional view of a waste toner collection device 29C according to a second exemplary embodiment of the present invention.

Figure 7:
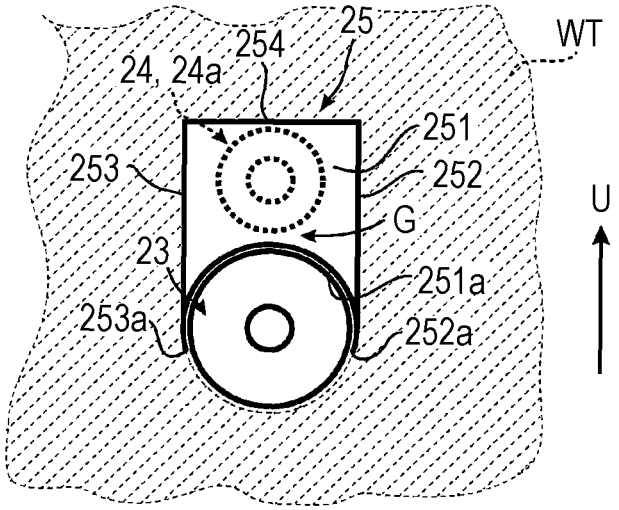
FIG. 7 is a schematic sectional view of part of the inside of a waste toner collection container illustrating a section indicated by arrows VII-VII illustrated in FIG. 6.

Furthermore, FIG. 7 is a schematic sectional view of part of the inside of the waste toner collection container illustrating a section indicated by arrows VII-VII illustrated in FIG. 6.

For description of the second exemplary embodiment illustrated in FIGS. 6 and 7, only the difference between the second exemplary embodiment and the first exemplary embodiment illustrated in FIGS. 4 and 5 is described.

The entrance suppressing member 25 according to the second exemplary embodiment does not include the lower plate 255, which is included in the entrance suppressing member 25 according to the first exemplary embodiment. Thus, the lower side of the entrance suppressing member 25 according to the second exemplary embodiment is open. Even in the case of the entrance suppressing member 25 that is open at its lower side, this open portion is closed by the first auger 23. Thus, even when the process unit 20 is removed from the printer 100, and the waste toner collection container 22 is reoriented, the amount of the waste toner WT entering the gap G is small. Thus, entrance of the waste toner to such a degree that a wall of the waste toner WT is formed in the gap G may be prevented. Meanwhile, with the entrance suppressing member 25 having an open lower side, compared to the case with the entrance suppressing member 25 having a closed lower side, the waste toner WT is easily fed to a space below the first auger 23 in the waste toner collection container 22. This may allow a space inside the waste toner collection container 22 to be more effectively used as a waste toner WT containing space.

Furthermore, the first side plate 252 and the second side plate 253 of the entrance suppressing member 25 according to the second exemplary embodiment extend so that a lower edge 252*a* and a lower edge 253*a* thereof are positioned below the center line of rotation of the first auger 23 (center line of the rotational shaft 231). In this case, entrance of the waste toner WT into the gap G may be more effectively suppressed than in the case where the lower edge 252*a* and the lower edge 253*a* of the first side plate 252 and the second side plate 253 are positioned above the center of rotation of the first auger 23.

Figure 8:
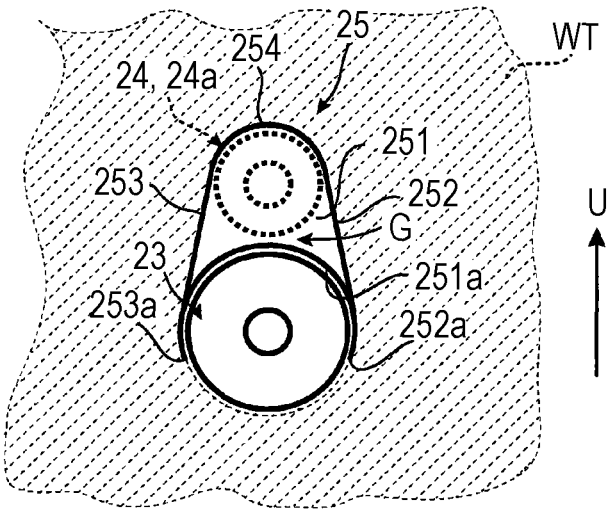
FIG. 8 illustrates a variation of the entrance suppressing member according to the second exemplary embodiment, corresponding to FIG. 7.

FIG. 8 illustrates a variation of the entrance suppressing member according to the second exemplary embodiment, corresponding to FIG. 7.

In the case of the entrance suppressing member 25 illustrated in FIG. 8, the first side plate 252 and the second side plate 253 are inclined so as to follows the shapes of side portions of the first auger 23 and also follows the shapes of side portions of the end portion 24*a* of the second auger 24, which has a smaller diameter than that of the first auger 23. Furthermore, the upper plate 254 has an arc shape that follows an outer circumference of the end portion 24*a* of the second auger 24. Furthermore, the lower side of this entrance suppressing member 25 is open as is the case with the entrance suppressing member 25 illustrated in FIG. 7.

In the case of the entrance suppressing member 25 illustrated in FIG. 8, compared to the entrance suppressing member 25 illustrated in FIG. 7, an inner space is reduced, thereby the waste toner WT containing space is increased in the waste toner collection container 22.

Figure 9:
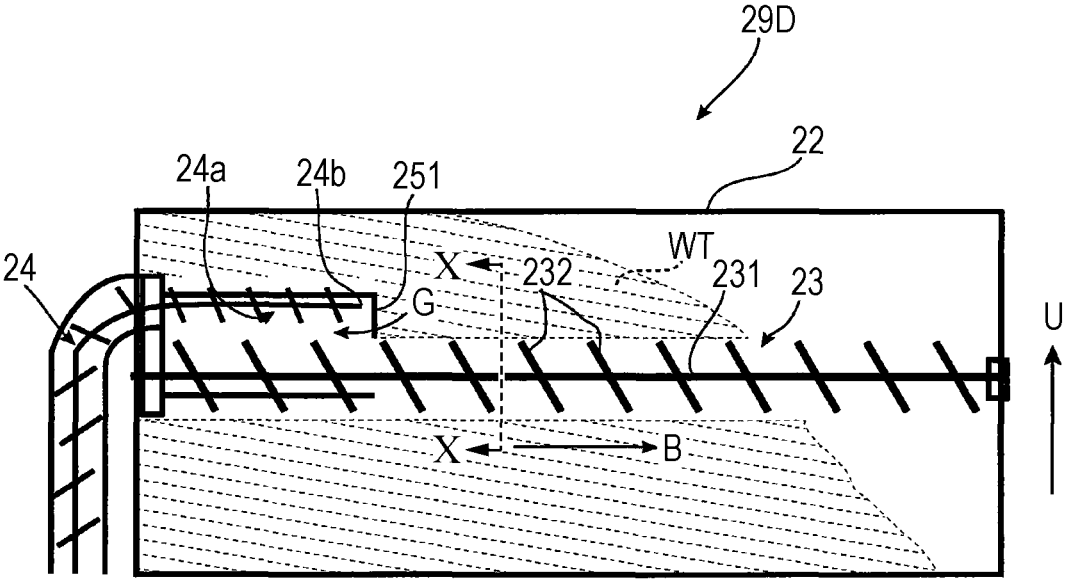
FIG. 9 is a schematic sectional view of a waste toner collection device according to a third exemplary embodiment of the present invention.

FIG. 9 is a schematic sectional view of a waste toner collection device 29D according to a third exemplary embodiment of the present invention.

Figure 10:
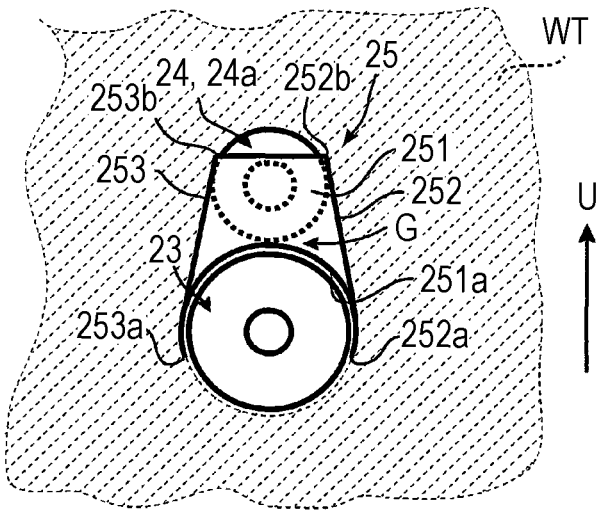
FIG. 10 is a schematic sectional view of part of the inside of a waste toner collection container illustrating a section indicated by arrows X-X illustrated in FIG. 9.

Furthermore, FIG. 10 is a schematic sectional view of part of the inside of the waste toner collection container illustrating a section indicated by arrows X-X illustrated in FIG. 9.

For description of the third exemplary embodiment illustrated in FIGS. 9 and 10, the difference between the third exemplary embodiment and the above-described first and second exemplary embodiments is described.

As is the case with the entrance suppressing member 25 of the variation of the second exemplary embodiment illustrated in FIG. 8, in the entrance suppressing member 25 according to the third exemplary embodiment, as illustrated in FIG. 10, the first side plate 252 and the second side plate 253 are inclined so as to follow the shapes of the side portions of the first auger 23 and also follow the shapes of the side portions of the end portion 24*a* of the second auger 24, which has a smaller diameter than that of the first auger 23.

Furthermore, as is the case with the second exemplary embodiment (see FIGS. 6 to 8), the entrance suppressing member 25 according to the third exemplary embodiment does not include the lower plate 255, which is included in the entrance suppressing member 25 according to the first exemplary embodiment (see FIGS. 4 and 5). Thus, the lower side of the entrance suppressing member 25 according to the third exemplary embodiment is open. As described above, with the entrance suppressing member 25 having an open lower side, compared to the case with the entrance suppressing member 25 having a closed lower side, the waste toner WT is easily fed to the space below the first auger 23 in the waste toner collection container 22. This may allow the space inside the waste toner collection container 22 to be more effectively used as the waste toner WT containing space.

Furthermore, the entrance suppressing member 25 according to the third exemplary embodiment does not include the upper plate 254 either, which is included in the entrance suppressing member 25 according to the first exemplary embodiment (see FIGS. 4 and 5) and the second exemplary embodiment (see FIGS. 6 to 8). Thus, also, the upper side of the entrance suppressing member 25 according to the third exemplary embodiment is open. Even in the case of the entrance suppressing member 25 that is open at its upper side, this open portion is substantially closed by the second auger 24. Thus, even when the process unit 20 is removed from the printer 100, and the waste toner collection container 22 is reoriented, the amount of the waste toner WT entering the gap G is small. Thus, entrance of the waste toner to such a degree that a wall of the waste toner WT is formed in the gap G may be prevented. Meanwhile, with the entrance suppressing member 25 having an open upper side, part of the waste toner WT of the waste toner WT having been transported to the end portion 24*a* by the second auger 24 is pushed upward by the end portion 24*a*. Accordingly, compared to the case with the entrance suppressing member 25 having a closed upper side, the waste toner WT is easily fed to a space above the second auger 24 in the waste toner collection container 22. This may allow the space inside the waste toner collection container 22 to be more effectively used as the waste toner WT containing space.

Here, as is the case with the entrance suppressing member 25 according to the second exemplary embodiment, the first side plate 252 and the second side plate 253 of the entrance suppressing member 25 according to the third exemplary embodiment extend so that the lower edge 252*a* and the lower edge 253*a* thereof are positioned below the center line of rotation of the first auger 23 (center line of the rotational shaft 231). In this case, entrance of the waste toner WT into the gap G may be more effectively suppressed than in the case where the lower edge 252*a* and the lower edge 253*a* of the first side plate 252 and the second side plate 253 are positioned above the center of rotation of the first auger 23.

Furthermore, the first side plate 252 and the second side plate 253 of the entrance suppressing member 25 according to the third exemplary embodiment extend so that an upper edge 252*b* and an upper edge 253*b* thereof are positioned above the center line of rotation of the end portion 24*a* of the second auger 24 (center line of a rotational shaft). In this case, entrance of the waste toner WT into the gap G may be more effectively suppressed than in the case where the upper edge 252*b* and the upper edge 253*b* of the first side plate 252 and the second side plate 253 are positioned below the center of rotation of the second auger 24.

Figure 11:
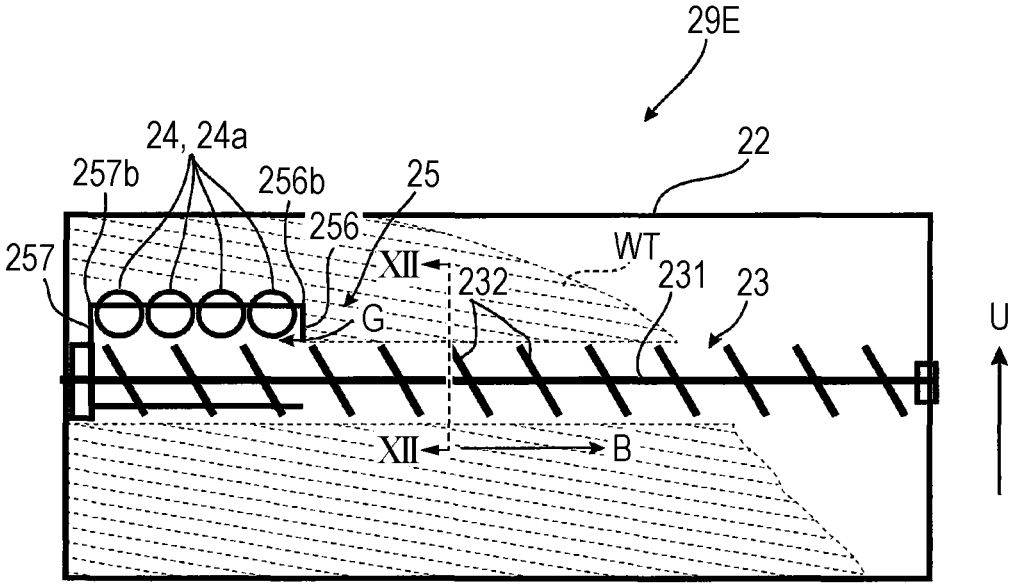
FIG. 11 is a schematic sectional view of a waste toner collection device according to a fourth exemplary embodiment of the present invention.

FIG. 11 is a schematic sectional view of a waste toner collection device 29E according to a fourth exemplary embodiment of the present invention.

Figure 12:
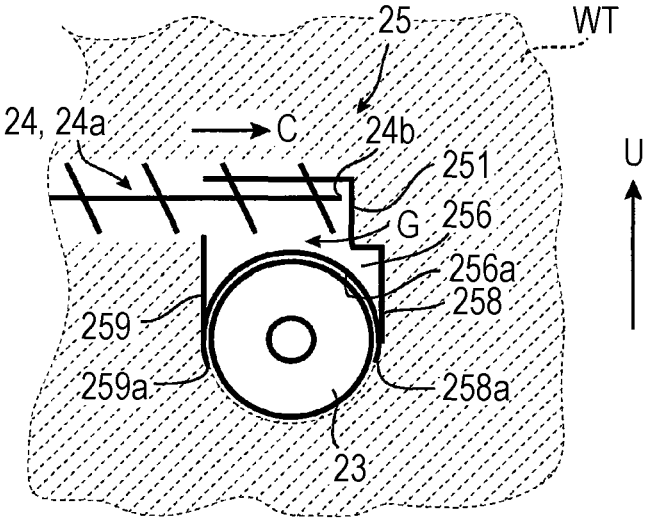
FIG. 12 is a schematic sectional view of part of the inside of a waste toner collection container illustrating a section indicated by arrows XII-XII illustrated in FIG. 11.

Furthermore, FIG. 12 is a schematic sectional view of part of the inside of the waste toner collection container illustrating a section indicated by arrows XII-XII illustrated in FIG. 11.

According to the fourth exemplary embodiment illustrated in FIGS. 11 and 12, four of the second auger 24 are provided at sequentially arranged positions. The end portion 24*a* of each of the second augers 24 is inserted into the waste toner collection container 22 and extends, above the first auger 23, in an arrow C direction (see FIG. 12) intersecting the arrow B direction in which the first auger 23 extends.

An electrophotographic color printer that forms a color image by using toner of four colors, that is, cyan (C), magenta (M), yellow (Y), and black (K) may be more effectively used. Since the basic structure of such an electrophotographic color printer is widely known, description of the structure of the color printer itself is omitted here.

The four second augers 24 illustrated in FIGS. 11 and 12 transport the waste toner WT of the respective colors C, M, Y, and K to the waste toner collection container 22.

The entrance suppressing member 25 according to the fourth exemplary embodiment includes the front plate 251, a third side plate 256, a fourth side plate 257, a fifth side plate 258, and a sixth side plate 259.

As is the case with the front plate 251 of the entrance suppressing member 25 according to the first to third exemplary embodiments, the front plate 251 of the entrance suppressing member 25 according to the fourth exemplary embodiment faces the ends 24*b* of the end portions 24*a* of the second augers 24. According to the present exemplary embodiment, four of the second auger 24 are provided. The front plate 251 faces the entirety of the ends 24*b* of the end portions 24*a* of the four second augers 24.

Furthermore, the third side plate 256 and the fourth side plate 257 respectively face one side portion (right side portion in FIG. 11) of the end portion 24*a* of the second auger 24 and the other side portion (left side portion in FIG. 11) of the end portion 24*a* of the second auger 24. According to the present exemplary embodiment, four second augers 24 are provided. Thus, the third side plate 256 is disposed to the right of the end portion 24*a* of one of the second augers 24 at the rightmost position in FIG. 11, and the fourth side plate 257 is disposed to the left of the end portion 24*a* of another second auger 24 at the leftmost position in FIG. 11. That is, the third side plate 256 and the fourth side plate 257 are disposed such that an array of the end portions 24*a* of four second augers 24 is entirely interposed between the third side plate 256 and the fourth side plate 257.

Furthermore, the fifth side plate 258 and the sixth side plate 259 are disposed beside part of the first auger 23 on which the end portions 24*a* of the second augers 24 are superposed in the up-down direction. That is, the fifth side plate 258 and the sixth side plate 259 are disposed at positions so as to respectively face one side portion (right side portion in FIG. 12) and the other side portion (left side portion in FIG. 12) of the part of the first auger 23 on which the end portions 24*a* of the second augers 24 are superposed in the up-down direction.

Here, in the case of the entrance suppressing member 25 according to the fourth exemplary embodiment, the front plate 251 and the fifth side plate 258 are arranged in a stepped manner as illustrated in FIG. 12. However, the front plate 251 and the fifth side plate 258 may be integrally formed by a single plate by arranging the first auger 23 and the ends 24*b* of the end portions 24*a* of the second augers 24 such that the side portion of the first auger 23 on the fifth side plate 258 side and the ends 24*b* are substantially aligned with one another in the up-down direction. The entrance suppressing member 25 according to the fourth exemplary embodiment includes neither the upper plate nor the lower plate, and this entrance suppressing member 25 is open at both the upper and lower sides thereof as is the case with the entrance suppressing member 25 according to the third exemplary embodiment (see FIGS. 8 and 9). Even in the case of the entrance suppressing member 25 that is open at its upper side, this open portion is substantially closed by the second augers 24. Thus, even when the process unit 20 is removed from the printer 100, and the waste toner collection container 22 is reoriented, the amount of the waste toner WT entering the gap G is small. Thus, entrance of the waste toner to such a degree that a wall of the waste toner WT is formed in the gap G may be prevented. Meanwhile, with the entrance suppressing member 25 having an open upper side, part of the waste toner WT of the waste toner WT having been transported to the end portions 24*a* by the second augers 24 is pushed upward by the end portions 24*a*. Accordingly, compared to the case with the entrance suppressing member 25 having a closed upper side, the waste toner WT is easily fed to a space above the second augers 24 in the waste toner collection container 22. This may allow the space inside the waste toner collection container 22 to be more effectively used as the waste toner WT containing space.

Furthermore, even in the case of the entrance suppressing member 25 that is open at its lower side, this open portion is closed by the first auger 23. Thus, even when the process unit 20 is removed from the printer 100, and the waste toner collection container 22 is reoriented, the amount of the waste toner WT entering the gap G is small. Thus, entrance of the waste toner to such a degree that a wall of the waste toner WT is formed in the gap G may be prevented. Meanwhile, with the entrance suppressing member 25 having an open lower side, compared to the case with the entrance suppressing member 25 having a closed lower side, the waste toner WT is easily fed to the space below the first auger 23 in the waste toner collection container 22. This may allow the space inside the waste toner collection container 22 to be more effectively used as the waste toner WT containing space.

Furthermore, the third side plate 256 and the fourth side plate 257 of the entrance suppressing member 25 according to the fourth exemplary embodiment extend so that an upper edge 256*b* and an upper edge 257*b* thereof are positioned above the center lines of rotation of the end portions 24*a* of the second augers 24 (center lines of rotational shafts). In this case, entrance of the waste toner WT into the gap G may be more effectively suppressed than in the case where the upper edge 256*b* and the upper edge 257*b* of the third side plate 256 and the fourth side plate 257 are positioned below the centers of rotation of the second augers 24.

Furthermore, as is the case with the entrance suppressing member 25 according to the third exemplary embodiment, the fifth side plate 258 and the sixth side plate 259 of the entrance suppressing member 25 according to the fourth exemplary embodiment extend so that a lower edge 258*a* and a lower edge 259*a* thereof are positioned below the center line of rotation of the first auger 23 (center line of the rotational shaft 231). In this case, entrance of the waste toner WT into the gap G may be more effectively suppressed than in the case where the lower edge 258*a* and the lower edge 259*a* of the fifth side plate 258 and the sixth side plate 259 are positioned above the center of rotation of the first auger 23.

Furthermore, the third side plate 256 and the fourth side plate 257 of the entrance suppressing member 25 according to the fourth exemplary embodiment extend to positions where the third side plate 256 and the fourth side plate 257 intersect the first auger 23. Out of the third side plate 256 and the fourth side plate 257, the third side plate 256, which is disposed on the downstream side in the transport direction of the first auger 23 (arrow B direction illustrated in FIG. 11), has an opening 256*a* that allows the first auger 23 to penetrate therethrough. The shape of the opening 256*a* follows the outer circumference of the locus of rotation of the first auger 23. That is, the opening 256*a* has an edge having a shape that follows the outer circumference of the helical blade 232 of the first auger 23. Since this opening 256*a* has the edge having a shape following the outer circumference of the locus of rotation of the first auger 23, when the waste toner collection container 22 is in the standing orientation in which the left side thereof in FIG. 4 is on the lower side, entrance of the waste toner WT through the opening 256*a* may be more effectively suppressed than in the case where the opening 256*a* has a shape not following the outer circumference of the locus of rotation of the first auger 23, that is, a partially increasing gap is formed between the edge of the opening 256*a* and the outer circumference of the locus of rotation of the first auger 23.

Furthermore, the lengths of the fifth side plate 258 and the sixth side plate 259 are, in the direction in which the first auger 23 extends (arrow B direction), equal to or larger than two turns (about four turns in the example illustrated in FIG. 11) of the helical blade 232. When the lengths of the fifth side plate 258 and the sixth side plate 259 are equal to or larger than two turns of the helical blade 232, entrance of the waste toner WT through the opening 256*a* may be more effectively suppressed than in the case where the lengths of the fifth side plate 258 and the sixth side plate 259 are smaller than two turns of the helical blade 232.

The entrance suppressing member 25 according to the fourth exemplary embodiment includes neither the upper plate 254 nor the lower plate 255 whereas the entrance suppressing member 25 according to the first exemplary embodiment includes the upper plate 254 and the lower plate 255 (see FIGS. 4 and 5). However, the entrance suppressing member 25 according to the fourth exemplary embodiment may include either or both of the upper plate 254 and the lower plate 255, so that entrance of the waste toner WT into the entrance suppressing member 25 may be more strongly suppressed.

Furthermore, although the entrance suppressing member 25 according to the fourth exemplary embodiment includes four second augers 24, the entrance suppressing member 25 is also able to be similarly configured in the case where a single second auger 24 is provided, or the number of second augers 24 being provided is more than one but not four.

Furthermore, the waste toner collection container 22 is assembled in the process unit 20, and the process unit 20 including the waste toner collection container 22 is mounted in or removed from the printer 100 herein. However, apparatuses or devices for which techniques described herein are applicable are not limited to a printer including the process unit 20. That is, it is sufficient that the waste toner collection container 22 be mounted or removed together with at least the first auger 23 included therein. The waste toner collection container 22 may be mounted or removed together with other elements than the first auger 23.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder collection device comprising:

a powder collection container removably mounted in an apparatus in which powder is collected;

a first transport member that is disposed in the powder collection container, that extends in a first transport direction, and that is to transport the powder received on an upstream side in the first transport direction to a downstream side in the first transport direction when the first transport member is rotated;

at least one second transport member that extends in a second transport direction, that has an end portion which is inserted into the powder collection container and which is positioned, in a mounting orientation in which the powder collection container is mounted in the apparatus, above part of the first transport member on the upstream side, and that transports, when the at least one second transport member is rotated, the powder in the second transport direction and passes the powder to part of the first transport member positioned below the end portion in the mounting orientation; and an entrance suppressing member that suppresses entrance of the powder into a gap between the first transport member and the end portion of the at least one second transport member when the powder collection container is reoriented such that the upstream side and the downstream side are respectively disposed at a lower position than a position of the upstream side in the mounting orientation and an upper position than a position of the downstream side in the mounting orientation.

2. The powder collection device according to claim 1, wherein the first transport member has a first side portion and a second side portion, wherein the end portion of the at least one second transport member has an end, a first side portion, and a second side portion, wherein the end portion of the at least one second transport member extends in a direction coincident with the direction in which the first transport member extends, and wherein the entrance suppressing member at least includes a front plate that faces the end of the end portion of the at least one second transport member, a first side plate that faces the first side portion of the first transport member and the first side portion of the end portion of the at least one second transport member, and a second side plate that faces the second side portion of the first transport member and the second side portion of the end portion of the at least one second transport member.

3. The powder collection device according to claim 2, wherein the first side plate has an upper edge and the second side plate has an upper edge, and wherein, in the mounting orientation, the upper edge of the first side plate and the upper edge of the second side plate are positioned above a center line of rotation of the at least one second transport member.

4. The powder collection device according to claim 2, wherein the first side plate has a lower edge and the second side plate has a lower edge, and wherein, in the mounting orientation, the lower edge of the first side plate and the lower edge of the second side plate are positioned below a center line of rotation of the first transport member.

5. The powder collection device according to claim 2, wherein the front plate faces the end of the end portion of the at least one second transport member and extends to a position where the front plate intersects the first transport member, and wherein the front plate has an opening that allows the first transport member to be inserted therethrough and that has a shape following an outer circumference of a locus of rotation of the first transport member.

6. The powder collection device according to claim 2, wherein the first transport member includes a helical blade, and wherein lengths of the first side plate and the second side plate are equal to or larger than two turns of the helical blade in the direction in which the first transport member extends.

7. The powder collection device according to claim 2, wherein, part of the entrance suppressing member that exists below the first transport member in the mounting orientation is open.

8. The powder collection device according to claim 1, wherein the first transport member has a first side portion and a second side portion, wherein the end portion of the at least one second transport member has an end, a first side portion, and a second side portion, wherein the end portion of the at least one second transport member extends in a direction intersecting the direction in which the first transport member extends, and wherein the entrance suppressing member at least includes a front plate that faces the end of the end portion of the at least one second transport member, a third side plate and a fourth side plate that respectively face the first side portion and the second side portion of the end portion of the at least one second transport member, and a fifth side plate and a sixth side plate that respectively face the first side portion and the second side portion of part of the first transport member, the part of the first transport member and the at least one second transport member being superposed on each other in the up-down direction in the mounting orientation.

9. The powder collection device according to claim 8, wherein the third side plate has an upper edge and the fourth side plate has an upper edge, and wherein, in the mounting orientation, the upper edge of the third side plate and the upper edge of the fourth side plate are positioned above a center line of rotation of the at least one second transport member.

10. The powder collection device according to claim 8, wherein the fifth side plate has a lower edge and the sixth side plate has a lower edge, and wherein, in the mounting orientation, the lower edge of the fifth side plate and the lower edge of the sixth side plate are positioned below a center line of rotation of the first transport member.

11. The powder collection device according to claim 8, wherein the third side plate and the fourth side plate face the end portion of the at least one second transport member and extend to positions where the third side plate and the fourth side plate intersect the first transport member, and wherein one of the third side plate and the fourth side plate disposed downstream of another of the third side plate and the fourth side plate in the first transport direction has an opening that allows the first transport member to be inserted therethrough and that has a shape following an outer circumference of a locus of rotation of the first transport member.

12. The powder collection device according to claim 8, wherein the first transport member includes a helical blade, and wherein lengths of the fifth side plate and the sixth side plate are equal to or larger than two turns of the helical blade in the direction in which the first transport member extends.

13. The powder collection device according to claim 8, wherein part of the entrance suppressing member that exists below the first transport member in the mounting orientation is open.

14. The powder collection device according to claim 8, wherein the at least one second transport member includes a plurality of second transport members, wherein the end portions of the plurality of second transport members are inserted into the powder collection container, extend in a direction intersecting the direction in which the first transport member extends, and are sequentially arranged, and wherein the entrance suppressing member at least includes a front plate that extends so as to face the ends of the end portions of the plurality of the second transport members, a seventh side plate and an eighth side plate between which the end portions of the plurality of second transport members are entirely interposed, and a ninth side plate and a tenth side plate that respectively face the first side portion and the second side portion of part of the first transport member, the part of the first transport member and the plurality of second transport members being superposed on one another in the up-down direction in the mounting orientation.

15. The powder collection device according to claim 2, wherein the first transport member has a lower portion and the end portion of the second transport member has an upper portion, and wherein the entrance suppressing member further includes at least one of an upper plate that faces the upper portion of the end portion of the second transport member and a lower plate that faces the lower portion of the first transport member.

16. An image forming apparatus comprising:

an image forming apparatus body that is to form an image on a sheet of paper with powder; and the powder collection device according to claim 1 that collects the powder which becomes unnecessary for the image forming apparatus body.

17. The image forming apparatus according to claim 16, further comprising:

an assembly which is removably mounted in the image forming apparatus body and in which at least the powder collection container and the first transport member of the powder collection device are assembled.

* * * * *